US006652736B1

(12) United States Patent
Del Pozo et al.

(10) Patent No.: US 6,652,736 B1
(45) Date of Patent: Nov. 25, 2003

(54) STRIPPING METHOD FOR EXTRACTING SOLID FLUIDIZED PARTICLES AND IMPLEMENTING DEVICE

(75) Inventors: Mariano Del Pozo, Le Havre (FR); Tanneguy Descazeaud, Saint Just le Martel (FR); Daniel Barthod, Honfleur (FR)

(73) Assignee: Total Raffinage Distribution S.A., Puteaux (FR)

( * ) Notice: Subject to any disclaimer, the term of this patent is extended or adjusted under 35 U.S.C. 154(b) by 0 days.

(21) Appl. No.: 09/720,903

(22) PCT Filed: Jun. 29, 1999

(86) PCT No.: PCT/FR99/01560

§ 371 (c)(1),
(2), (4) Date: Apr. 23, 2001

(87) PCT Pub. No.: WO00/01786

PCT Pub. Date: Jan. 13, 2000

(30) Foreign Application Priority Data

Jul. 2, 1998 (FR) ..... 98 08457

(51) Int. Cl.[7] ..... C10G 11/00; C10G 11/04; B01J 8/18

(52) U.S. Cl. ..... 208/113; 208/128; 208/129; 208/130; 208/150; 422/139; 422/140; 422/141; 422/142; 422/143; 422/144; 422/145; 422/146

(58) Field of Search ..... 208/113, 128, 208/130, 129, 150; 422/139–146

(56) References Cited

U.S. PATENT DOCUMENTS

| | | | | |
|---|---|---|---|---|
| 5,059,305 A | * 10/1991 | Sapre | ..... | 208/113 |
| 5,284,575 A | 2/1994 | Owen | ..... | 208/161 |
| 5,393,415 A | 2/1995 | Sechrist et al. | ..... | 208/161 |
| 5,586,998 A | * 12/1996 | Gauthier | ..... | 55/391 |

FOREIGN PATENT DOCUMENTS

| | | | | |
|---|---|---|---|---|
| EP | 0 139 390 | 8/1984 | ..... | C10G/11/18 |
| EP | 0 545 771 A1 | 11/1992 | ..... | B01J/8/00 |

* cited by examiner

*Primary Examiner*—Walter D. Griffin
*Assistant Examiner*—Tam M. Nguyen
(74) *Attorney, Agent, or Firm*—Sughrue Mion, PLLC

(57) ABSTRACT

The invention concerns a stripping method for extracting solid fluidized particles whereby the particles to be stripped are subjected to a first stripping in a first chamber (9), then at least a second stripping in a second chamber (10) wherein are provided solid/gas separating means allowing the gaseous fluids derived from the second stripping to directly pass through from the bottom to the top but preventing them from going up again into the first chamber (9). The invention also concerns a device for implementing said method.

14 Claims, 10 Drawing Sheets

STRIPPING METHOD FOR EXTRACTING SOLID FLUIDIZED PARTICLES AND IMPLEMENTING DEVICE

The present invention relates to the processing of solid particles in fluidized beds. Its object is more specifically a method and a device to process solid particles in a fluidized bed by a fluid circulating against their flow direction, in particular in order to eliminate the components carried along with these particles and/or absorbed on them. This processing is commonly designated by the term "stripping".

The invention applies more specifically to techniques used in the oil industry, namely hydrocarbon conversion processes such as the process of catalytic cracking in fluidized bed (in English, Fluid Catalytic Cracking or FCC process).

In this type of process, the hydrocarbon charge is simultaneously vaporized and placed in contact at high temperature with a cracking catalyzer that is kept suspended in the charge vapors. After the desired mol weight range has been attained by cracking, and with a corresponding lowering of the boiling points, the catalyzer is separated from the products obtained. The catalyzer is quickly deactivated during the brief period when it is in contact with the charge, essentially due to an absorption of hydrocarbons as well as a depositing of coke and other contaminants on its active sites. It is thus necessary to continuously strip the deactivated catalyzer particles (or grains), for example by a fluid such as vapor, in order to recover from them the absorbed hydrocarbons carried along in the empty volume separating the grains, and to then regenerate them, likewise continuously, by a controlled combustion of the coke in a regenerating section before recycling the catalyzer grains to the reaction zone. These two processing operations, stripping and regeneration, are carried out in a fluidized bed.

In its type form, the stripper of the FCC process comprises only a single stirred extraction stage and thus can only be quite limited in efficacy.

The main purpose of the stripping of the catalyzer used in this process is to reduce the quantity of hydrocarbons returned to the regenerator. These hydrocarbons are divided into three categories:

interstitial hydrocarbons (between the grains), intra-granular hydrocarbons (in the grain pore spaces), absorbed hydrocarbons (at the grain pore surface).

Based on these three categories, three stages can be defined in stripping:

washing (moving the interstitial hydrocarbons), dissemination, and desorption.

It should be noted that these three operations are not independent of each other. In fact, it is clear that an efficacious washing will result in a concentration gradient between the outside and the inside of the grain. This will only improve the dissemination stage. It can be deduced from this that stripping efficacy is closely connected to desorption quality. Nevertheless, none of the three components can be neglected, since any hydrocarbon desorbing goes through the intra-granular stage and then the interstitial stage.

Use of the large industrial fluidized beds that are found particularly, but not exclusively, in these solid particle fluidized bed stripping and regeneration operations presents, however, a certain number of difficulties. The efficacy is considerably influenced on the one hand by an excessive fluidized bed concentration along the stripper axis and, on the other hand, by poor material transfer from the hydrocarbon-rich emulsion phase to the bubble phase, the only gaseous phase removed from the stripper.

It is thus necessary to carry out a consistent mixing there in order to ensure intimate mixing.

The inevitable rising of the vapor bubbles to the bed surface certainly does not allow an ideal movement of the particles against the flow. Indeed, the vapor bubbles cause catalyzer stripped from the bottom of the stripper to rise in their wake and this catalyzer reabsorbs the hydrocarbon vapors present at the surface or tossed back by grains of already stripped catalyzer. It is this phenomenon, referred to as retro-mixing, that it seems crucial to reduce in order to avoid reabsorbing hydrocarbons desorbed by already stripped catalyzer.

In addition, due to the necessary stirring of the fluidized bed, there is a sizeable quantity of non-stripped catalyzer grains that quickly go from the fluidized bed surface to the exit of the stripper. This is what is referred to as the "bypass" or "short-circuit", and it is important to reduce it in order to optimize the hydrocarbon extraction.

Various solutions have already been proposed.

The interposing of obstacles in the catalyzer's dense fluidized phase can be mentioned in particular; these are in the form of insides with quite diverse structures, as described in particular in French Patent No. 2,728,805 in the Applicant's name, or in the form of baffles. The function of these obstacles is to reduce in size or burst the vapor bubbles and thereby increase the surface of transfer toward the gas-solid emulsion while limiting the rising of the catalyzer.

This solution is limited in efficacy, however. Indeed, in practical experience, a fluidized bed is not exactly a perfect mixer. Numerous analyses have shown that although mixing along the stripper axis is quite efficacious there, radial mixing is far from satisfactory.

Consequently, in the case of homogenous vapor distribution, a stripper with internals may actually prove less efficacious than an empty stripper if these internals promote radial mixing and do not decrease axial mixing. With such internals, the conditions of a perfectly stirred reactor are better approximated and the "bypass" phenomenon is increased.

As another solution, PCC unit strippers are known that are equipped with multiple stage vapor injections, like the device described in U.S. Pat. No. 5,601,787. The hot-stripping housing comprises two stages arranged in the housing of the regenerator, with the stripping vapor of the second stage going through the first stage without touching the catalyzer coming from the first stage. However, this device only seems to be able to operate at high temperature.

To improve the stripping phase, we are clearly faced with a gas/solid extraction problem. The Applicant has determined, quite surprisingly, that a much surer way of improving stripping efficacy is by multiple stage extraction along several stripping chambers defined by partitions in the stripper housing in such a way that the bubbles that rise in one of the chambers are unable to carry catalyzer particles back into the (higher) preceding chamber. A multiple stage stripping with at least two chambers is thus created, with fresh stripping fluid, such as vapor, being fed into each chamber.

For this purpose, the primary object of the present invention is a method for stripping hydrocarbon-impregnated solid particles in a fluidized bed by means of a fluid circulating against the flow direction of these particles, implemented in a housing comprising, in its upper section, a diluted fluidized zone where the particles to be stripped arrive, and in its lower section, a dense fluidized bed zone, the latter comprising at least two chambers arranged basically adjacent, each of these chambers having separate means for inserting solid particles, and in its lower section, separate means for inserting gaseous stripping fluids, this method being characterized in that the solid particles arriving from this diluted fluidized zone are directed by a directing means toward the entrance of the first chamber without being able to directly enter the second chamber;

in that the solid particles to be stripped enter the first chamber in their entirety first of all by way of the upper section of the dense fluidized bed, in which they undergo a first stripping;

in that the solid particles having undergone this first stripping are then transferred into at least a second chamber which has in its upper section gas/solid separating means allowing the gaseous fluids from the stripping of the second chamber to pass directly from the bottom to the top, into the diluted fluidized zone located in the upper section of the housing;

and in that the solid particles having undergone a second stripping in this second chamber are then removed by way of the lower section of this second chamber.

The volume mass of the dense fluidized bed contained in each of the at least two chambers preferably ranges from 400 to 800 kg/m3.

In particular, the gaseous stripping fluid is vapor or nitrogen.

The flow rate of the stripping fluid of the first chamber advantageously ranges from 1.5 to 4 times that of the subsequent chamber or chambers. This configuration allows most of the hydrocarbons carried out along by the catalyzer (and not absorbed) to be removed in the first stage of the stripper.

According to a preferred form of construction, a substantial reduction of the stripping fluid surface speed takes place in each chamber, causing smaller bubbles, to form and thus increasing the transfer of the hydrocarbons in the gaseous phase.

A second object of the invention relates to a device for stripping hydrocarbon-impregnated solid particles in a fluidized bed by means of a gaseous fluid circulating against the flow direction of these particles, comprising:

a housing provided with an upper section able to allow the forming of a diluted fluidized zone for inserting the solid particles to be stripped, and a lower section able to allow the forming of a dense fluidized stripping zone divided into at least two chambers arranged roughly adjacent and each comprising a separate inserting device for solid particles and gaseous fluid, a pipe connected to the housing base for removal of the stripped particles, this device being characterized in that it comprises in the upper section of the second chamber at least one wall constituting at least one partition between these chambers working together with a deflector in order to remove the gaseous stripping fluids coming from the second chamber directly toward the diluted fluidized zone and to direct the fall of the solid particles to be stripped toward the entrance of the first stripping chamber.

This partition is advantageously formed in the lower section of this first chamber so as to have at least one opening for the particles to go from this chamber to the second chamber. In particular, the partition or partitions is/are arranged basically vertically.

According to a first variant, the partition or partitions share symmetric relative to the longitudinal axis of the stripping housing.

According to a second variant, the partition or partitions is/are arranged in the form of crosswise partitions.

The partitions are preferably offset from each other relative to the longitudinal axis of the stripping housing.

The deflector is advantageously arranged along the circumference of the stripping housing above the upper level of the dense fluidized bed and contiguous to the internal partition of the housing.

According to a variant method of execution, the deflector consists of an inclined partition starting from the internal partition of the housing toward its axis.

This deflector concentrates the gaseous fluids extracted from the at least two chambers above the upper level of the dense fluidized bed so as to carry out a preliminary stripping of the solid particles entering the first chamber and to limit hydrocarbon resorption by the stripped particles located at the surface of the dense fluidized bed.

Other characteristics and advantages of the invention will become clear when reading the description of several forms of construction of the stripping device, provided below and referring to the attached figures, among which:

Figure 1:
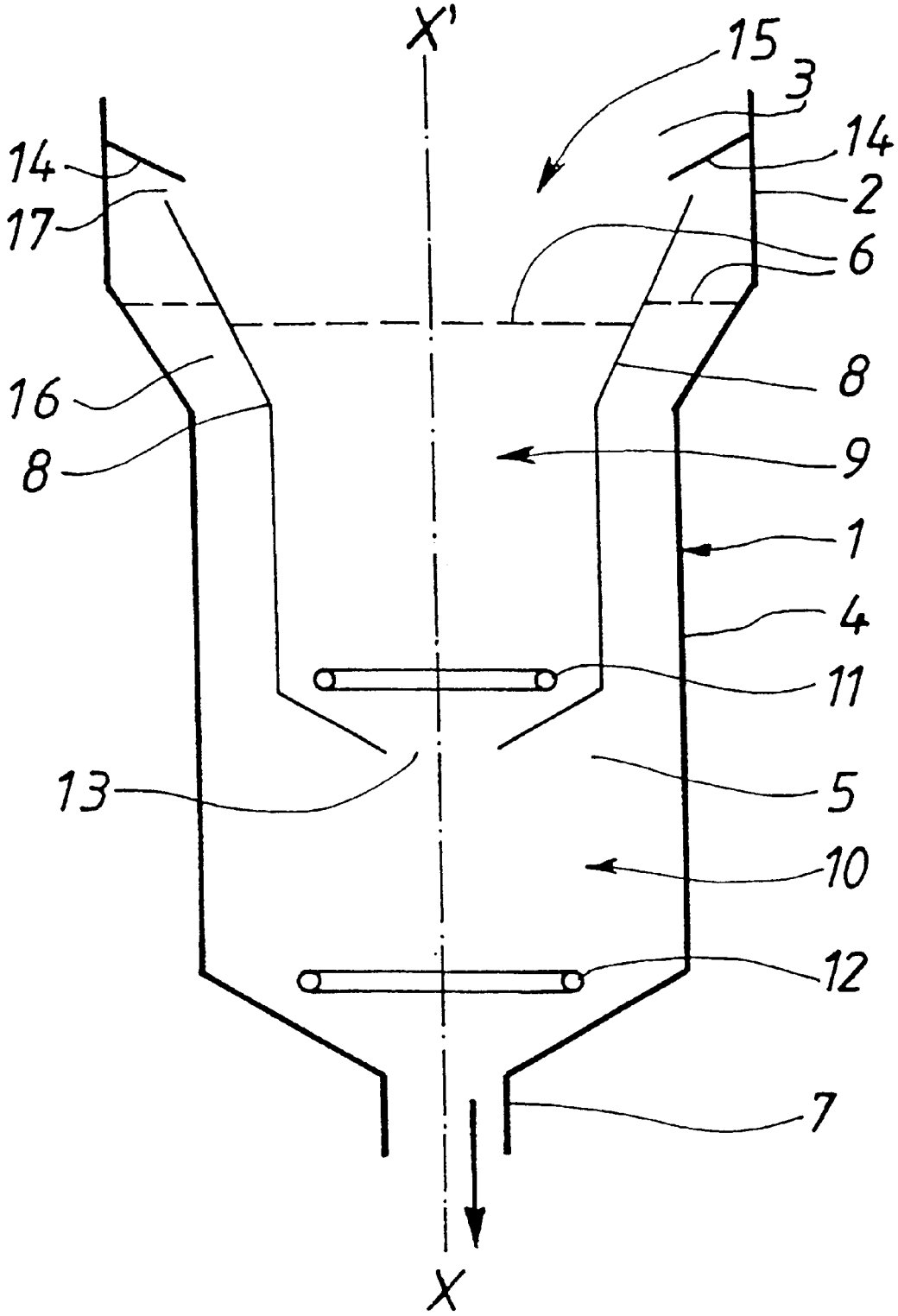
FIG. 1 represents a longitudinal section view of a first form of construction of the stripping device.

As shown by FIG. 1, which represents a stripping device with two chambers or stages, the vertical stripping housing 1 basically cylindrical in shape according to a symmetry axis XX', comprises at its upper section 2 a diluted fluidized zone 3 used for inserting deactivated catalyzer solid particles that fall by gravity after being separated from the cracked charge of a cracking catalyzer device of the FCC type (not illustrated); these particles form in the lower section 4 of the housing 1 a dense fluidized zone 5 the upper level of which is indicated in 6; the stripping housing 1 also comprises at its base a pipe 7 for removal of the stripped solid particles to a regenerator (not shown) in which, in known manner, the coke deposited on the catalyzer particles is burned by air.

According to the invention, the device comprises a partition 8 arranged inside the housing 1; it is basically cylindrical and coaxial with the housing but not as high, and it thus defines two multiple stage stripping chambers or stages 9, 10 each provided in their bottom with a device 11, 12 for inserting gaseous stripping fluid, in particular vapor, in the form of rings of injectors; the lower end of the partition 8 has a tapered shape delimiting a restricted opening 13 in order to limit as far as possible the rising and thus the removal of the gaseous fluid injected in 12 from the lower chamber 10 through the upper chamber 9, while providing sufficient passageway for the catalyzer particles emerging from the upper chamber to the second chamber 10.

In addition, the housing 1 is equipped with a deflector 14 in the form of an annular disk arranged above the upper level 6 of the fluidized bed and the upper end of the partition 8, thus delimiting an entry opening 15 for the catalyzer particles in the first chamber 9 while preventing direct introduction of catalyzer particles into the second chamber 10 through the removal zone 16 of the stripping gases coming from this chamber 10, this zone being delimited by the housing 1 and the partition 8; this deflector 14 forms an inclined partition attached to the partition of the housing 1 and slightly protruding above the upper end of the partition 8, while leaving a slit or opening 17 for removal of the gaseous fluids to the diluted fluidized zone 3.

This stripping device operates as follows: the deactivated catalyzer particles impregnated with hydrocarbons enter the diluted fluidized zone 3 of the housing 1, are channeled by the deflector 14 and enter through the opening 15 in the first chamber 9 (upper chamber) while undergoing a preliminary stripping upon contact with the gaseous stripping fluids (in particular vapor) flowing against them and coming from the separate removal zone 16 as well as from the chamber 9 and which are removed through the opening 15 after being gathered together. Thus, the catalyzer particles then move vertically from top to bottom and undergo a first stripping in the chamber 9 against the flow of the gaseous fluid emerging from the injectors 11, then enter through the opening 13 into the second chamber 10, where they are once again exposed to a current of fresh gaseous fluid emitted by the injectors 12 that continues the desorption of the hydrocarbons carried along by these particles; taking into account the tapered configuration of the lower end of the partition 8 of the first chamber 9, the gaseous fluid of this chamber 10 is forced to exit through the annular zone 16 without coming into contact with the particles in the chamber 9.

The risk of retro-mixing between stages by rising catalyzer is thus greatly reduced or even practically impossible; at the exit of the chamber 10, the stripped catalyzer particles are removed from the housing 1 through the pipe 7.

Indeed, it was noted that it was absolutely necessary not to allow already stripped catalyzer to encounter desorbed hydrocarbons. The internals currently present in refineries only partially deal with the problem of stripping, because even if they reduce the size of the bubbles, they cannot prevent retro-mixing; in addition, the vapor introduced at the bottom of the stripper goes through the entire catalyzer bed. Only a system with stages, like that of the invention, can make it possible to achieve this dual objective.

It is possible to replace the basically cylindrical partition 8 with two crosswise partitions that are symmetric relative to the axis XX', thus forming a crosswise partitioning of the housing 1.

Figure 2:
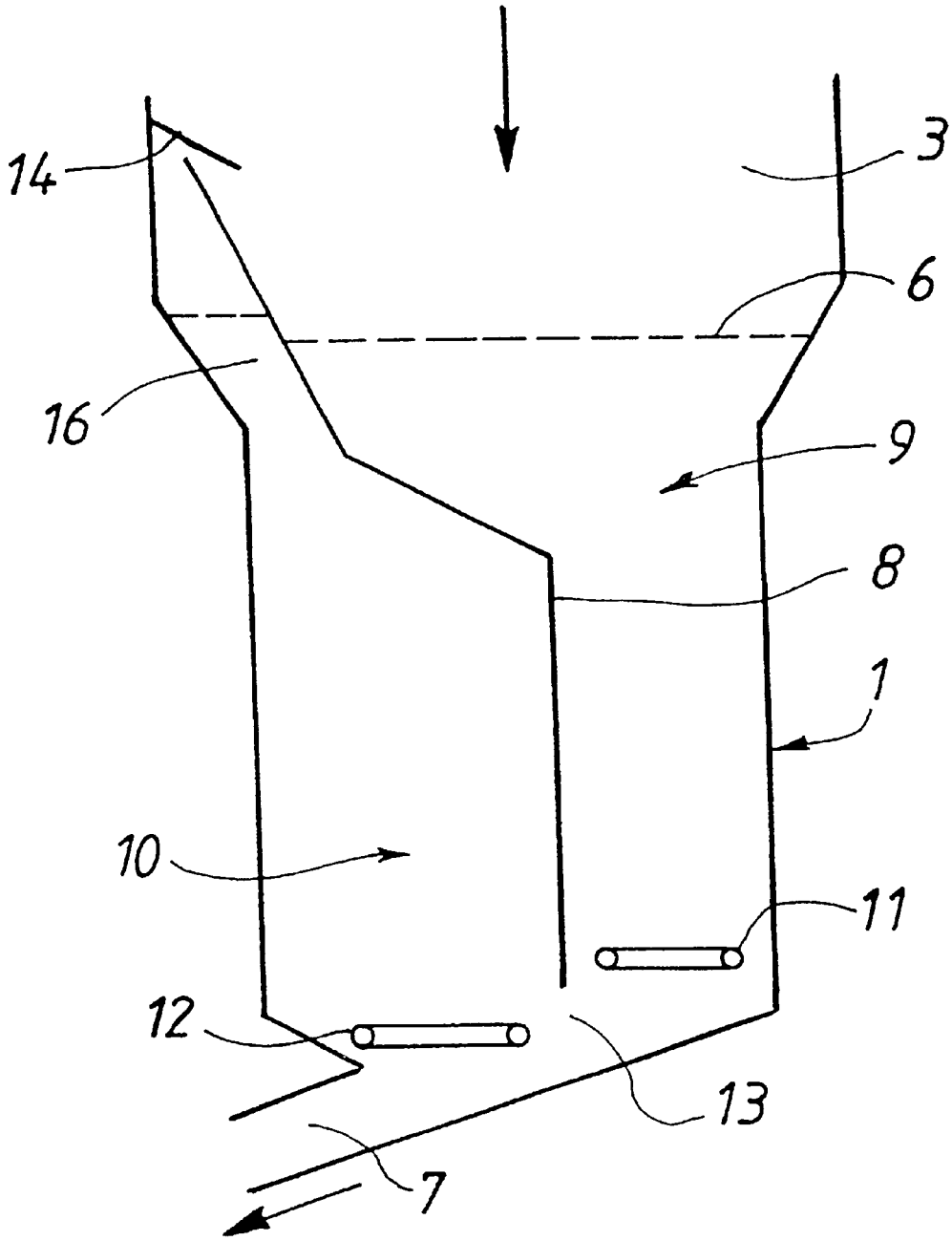
FIG. 2 represents a longitudinal section view of a second form of construction of the stripping device.

In a second form of construction, as represented by FIG. 2, there is only one crosswise partition 8 that separates the housing 1 into two chambers 9, 10 located basically at the same level and that leaves an opening 13 in the bottom of the housing 1 allowing the stripped particles coming from the first chamber 9 to go crosswise to the second chamber 10 where they undergo a second stripping by the gaseous fluid injectors 12 before being removed from the housing 1 through the pipe 7.

Figure 3:
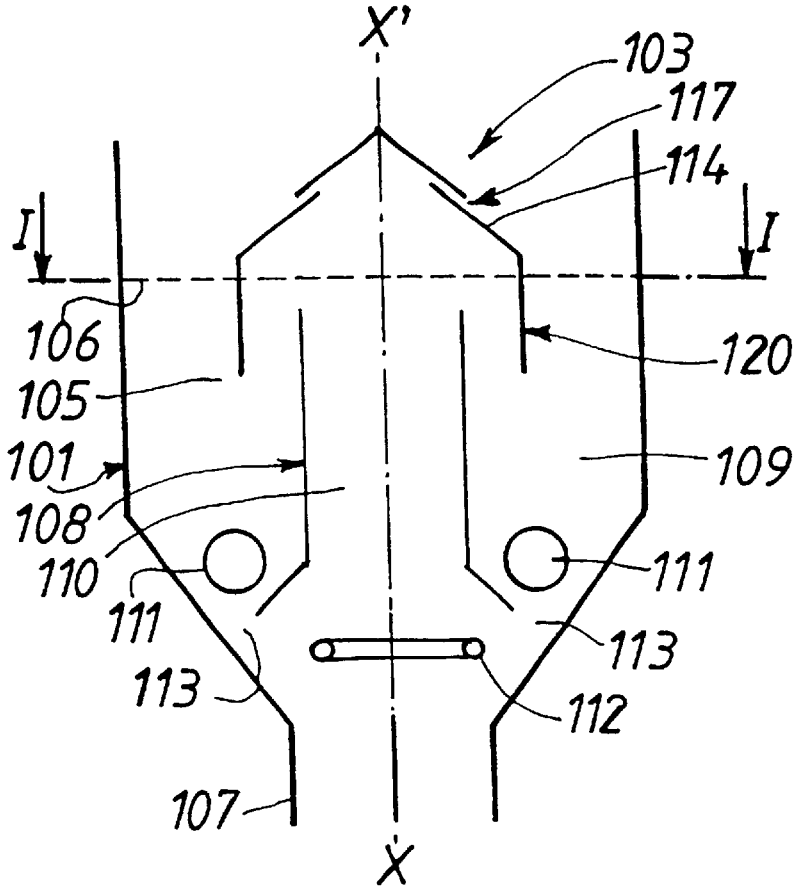
FIG. 3 represents a longitudinal section view of a third form of construction of the stripping device.
Figure 4:
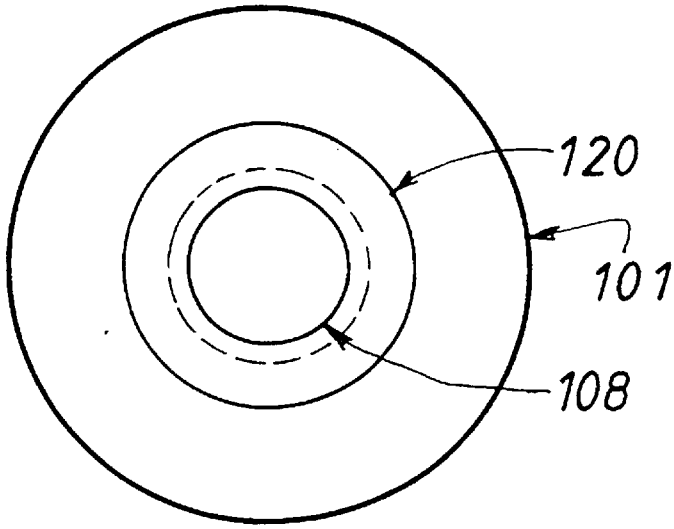
FIG. 4 represents an overhead sectional view along I—I of the form of construction of FIG. 3.

According to a third form of construction illustrated by FIGS. 3 and 4, the device according to the invention comprises a housing 101 divided into two chambers 109, 110 by a partition 108; it is rotationally symmetrical relative to the longitudinal axis XX' of the housing 101, in the form of a cylinder extended by a truncated cone whose base is spaced from the partition of the housing 101 so as to leave an opening 113 for the particles to transit; the partition 108 is covered by a cap-shaped covering or deflector 114 that prevents the particles coming from the diluted fluidized zone 103 from transiting directly to the chamber 110 on the one hand and, on the other hand, is provided with slits 117 for removing the stripping fluids coming from the injectors 111, 112 feeding chambers 109 and 110, respectively; this covering 114 may be extended into the chamber 109 by partitions 120; the covering 114 then has a cylindrical conical shape adapted to the chamber's 110 dimensions; the device operates as follows: the deactivated catalyzer particles enter the housing 101 through the zone 103 and form a dense fluidized bed 105 the upper level of which is indicated in 106; these particles circulate from the first chamber 109, where they undergo a first stripping by the fluids injected by the nozzles 111, to the second chamber 110, where they are subjected to the stripping fluids injected in 112 and then leave the housing 101 through the pipe 107; the stripping fluids are partly collected by the cap 114 and removed through the slits 117 so as to achieve a preliminary stripping of the particles entering through the zone 103.

In the same way as in the preceding forms of construction, the partition 108 may be formed by two parallel plates arranged crosswise in the housing 101 and forming a crosswise partition.

Figure 5:
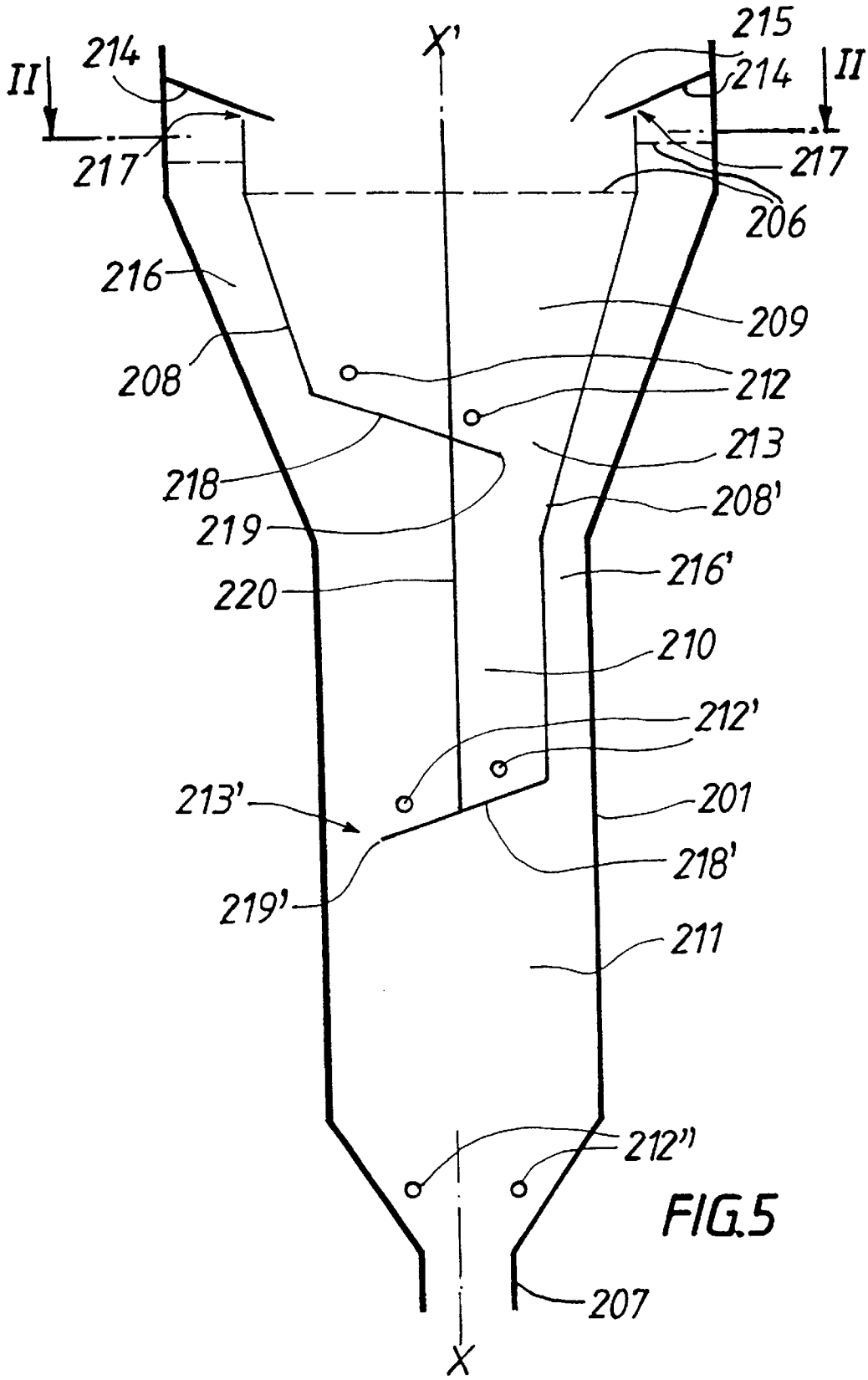
FIG. 5 illustrates a longitudinal section view of a fourth form of construction of a multiple stage stripper.
Figure 6:
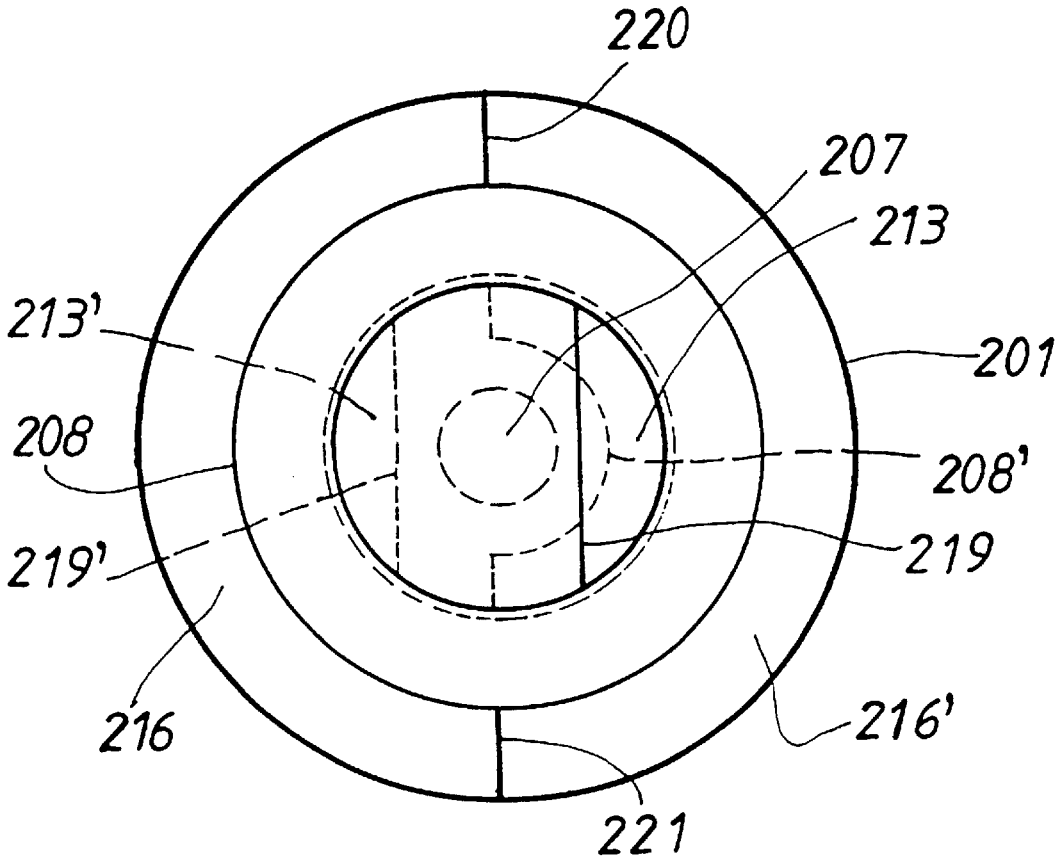
FIG. 6 illustrates an overhead sectional view along II—II of the form of construction of FIG. 5.

According to a fourth form of construction illustrated by FIGS. 5 and 6, which is a three-stage variant of the device of FIG. 1, the stripping device comprises a housing 201 in which is arranged a first partition 208 symmetric relative to the axis XX' of the housing, basically cylindrical in shape, with an upper edge that surpasses the upper level 206 of the dense fluidized bed, and roughly a third as high as the housing; its lower end consists of a plate 218 inclined in the direction of the housing axis XX' and forming roughly a 45 degree angle with the horizontal line (an angle greater than the 32 degree slope angle in order to have a satisfactory flow of the particles), and delimiting with its lower edge 219 a restricted opening 213, with the opposite partition; the partition 208 and the inclined plate 218 thus define a first stripping chamber 209 equipped in its bottom with gaseous stripping fluid injectors 212; the configuration of the partition 208 makes it possible to limit as far as possible the rising and thus the removal of the gaseous fluid coming from the lower chamber, while providing sufficient passageway for the catalyzer particles circulating toward the lower chamber; the partition 208 is toward the bottom of housing 201 by a second partition 208' also cylindrical in shape and coaxial with the housing 201, and which is roughly the same height as the partition 208 and whose lower end also consists of a plate 218' inclined toward the axis XX' of the housing, forming roughly a 45 degree angle with the horizontal line and defining with its lower edge 219' a restricted opening 213', with the housing 201, for the particles to transit; this partition 208' thus delimits second and third stripping chambers 210, 211 provided in their bottom with gaseous stripping fluid injectors 212', 212"; these chambers 210, 211 are equipped with a separate gaseous fluid removal zone 216, 216'.

For the stripping fluid removal zones 216 and 216' to be completely separate, vertical partitions 220, 221 shown in FIG. 6 are arranged between the partitions 208, 208' and the partition of the stripping housing 201. In addition, the housing 201 is equipped with an annular deflector or cover 214 arranged above the level 206 of the dense fluidized bed and the upper ends of the partition 208 of the upper chamber 209, thereby defining a zone 215 for entry of the catalyzer particles and removal of the stripping gases coming from the various chambers or stages; this coverage 214 forms an inclined partition attached to the partition of the housing 201 and protruding slightly above the upper partitions of the chamber 209 while leaving a slit or opening 217 for removal of the gaseous fluids emerging from the zones 216 and 216'.

This stripping device operates in the same way as the preceding ones, with the deactivated catalyzer particles thus moving vertically from top to bottom, undergoing a first stripping in the first chamber 209 against the flow direction of the gaseous fluid coming from the injectors 212, then entering through the opening 213 into the second chamber 210 where they are again exposed to a fresh gaseous fluid current emitted by the injectors 212', which continues the desorption of the hydrocarbons carried along by these particles, and transiting through the opening 213' into the third chamber 211 before they are removed from the stripper through the pipe 207.

The risk of retro-mixing between stages by rising catalyzer is thus greatly reduced or even practically impossible.

The roughly cylindrical partitions 208 and 208' may also be replaced by two crosswise particles that are asymmetric relative to the axis XX', thereby forming a crosswise partitioning of the housing 201.

A stripping device according to the invention is obviously not limited to the preceding examples, but also includes any device making it possible to compartmentalize the stripping housing into several consecutive stages in which the catalyzer particles circulate.

Among the other advantages provided by such a device, it should be pointed out that because "fresh" vapor is injected at each phase, a maximum extraction gradient is established.

In addition, the possibility to "bypass" the catalyzer is greatly reduced, as shown by the test results provided below; according to the kinetic analysis of the stripping, it was deemed that the entire catalyzer remaining in the stripper less than 15 seconds undergoes only a very partial stripping and the "bypass" quantity is defined as that catalyzer quantity that is poorly stripped.

The device according to the invention also makes it possible to decrease catalyzer dwell time in the stripper, hence a limiting of secondary cracking and coking reactions.

In addition, the surface speed of the gas or the relative gas-solid speed is lower since the flow injected in each stage is divided by the number of stages; for example, if there are N stages, the stripping gas flow introduced at each stage will be the total gas flow over N. This leads to a better transfer of the hydrocarbons from the emulsion phase to the bubbles phase, the only gaseous phase removed from the stripper, by forming smaller bubbles (increasing the exchange surface for the same volume of gas). A clear improvement is noted compared to already known systems for increasing transfer quality, by inserting conventional internals in the stripper (tube sheets, plates with holes, baffles . . . ).

The major parameters of the FCC catalyzer stripping were thus able to be obtained. The stripping is not limited by kinetics (relative to mean dwell time in industrial strippers, which is approx. 60 seconds); pressure and temperature seem to have a secondary influence and, moreover, are operating conditions that are difficult to chamber on industrial units.

Figure 7:
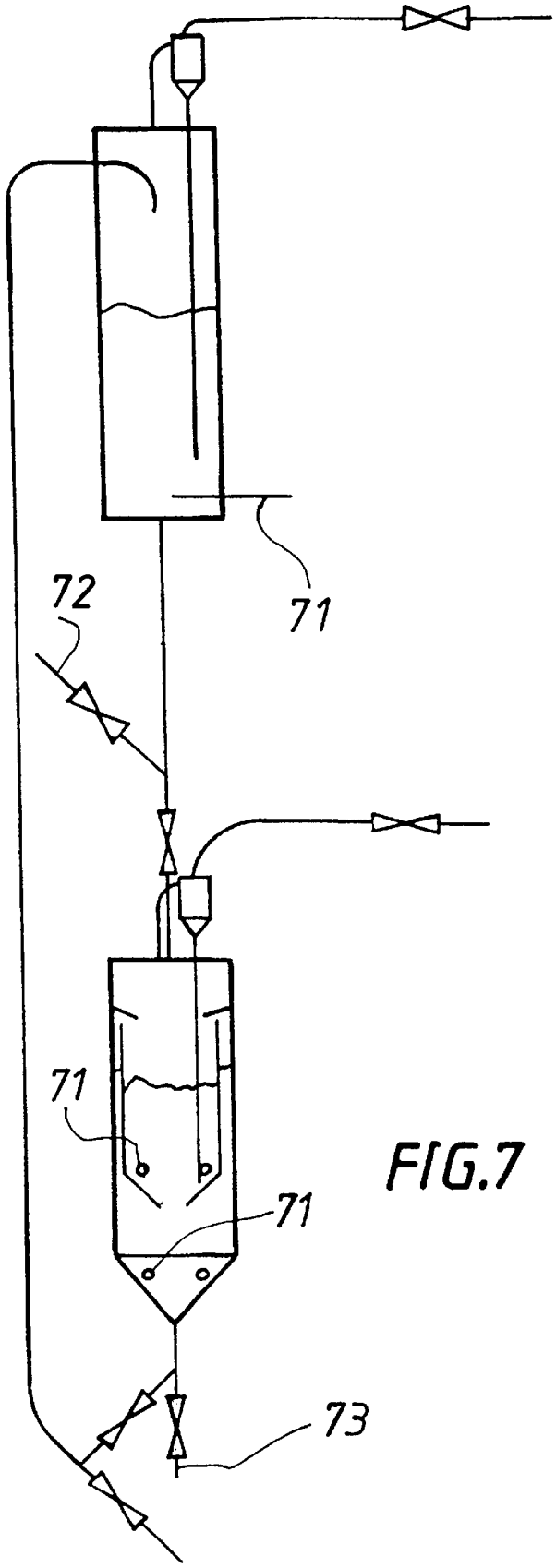
FIG. 7 shows a skeleton diagram of a model circulating bed used to test the device according to the invention.

In order to evaluate the performance of this stripping system according to the invention, also hereinafter referred to as extraction stripping, a cold circulating bed model comprising two stages (device similar to the one shown in FIG. 1) was implemented. Its skeleton diagram is illustrated in FIG. 7.

Experiments were conducted in the following operating conditions:

the catalyzer quantity is the same in each stage;

the fluidization air is sent in 71 through rings in the two stages; the flow of the upper stage is equal to that of the lower stage (11 m3/hour);

stripping air speed is thus:

4.6 cm/s in the lower stage, 18 cm/s in the gas removal zone, 6.2 cm/s in the upper stage;

circulation is approx. 600 kg/hour.

The tracer used and sent in 72 is "soiled" catalyzer, that is, catalyzer that was mixed with a volume of sodium-chloride-saturated water corresponding to the pore volume of the catalyzer; it was then dried in order to evaporate all of the water.

Samples are taken of the catalyzer at regular intervals at the exit 73 of the stripper; the samples taken are then mixed with a known volume of water in order to dissolve the salt present in the catalyzer; detection is carried out by measuring the conductivity of the solution obtained.

A Knowing the quantity of salt injected at t=0, the quantity sampled at time t and the mean dwell time in the stripper, the dwell time distribution (DTS) is deduced for each of the systems, and this makes it possible to trace a curve representing probable catalyzer particle dwell time in the stripper as a function of time.

The following conclusions can be drawn from these experiments:

the catalyzer circulates flawlessly in the extraction stripper without accumulating in the upper statuses, the air introduced in the lower stage is removed through the annular space provided between the stage separation partitions and the stripper housing partition without carrying catalyzer along with it, the catalyzer located in the gas removal zone is constantly renewed and thus does not constitute a dead volume.

To evaluate the performance of this system compared to state of the art strippers, dwell time distribution measurements were carried out on the model equipped successively with a multiple stage or extraction stripper as described above, an empty stripper and a stripper provided with an internal formed of tube sheets.

Figure 8:
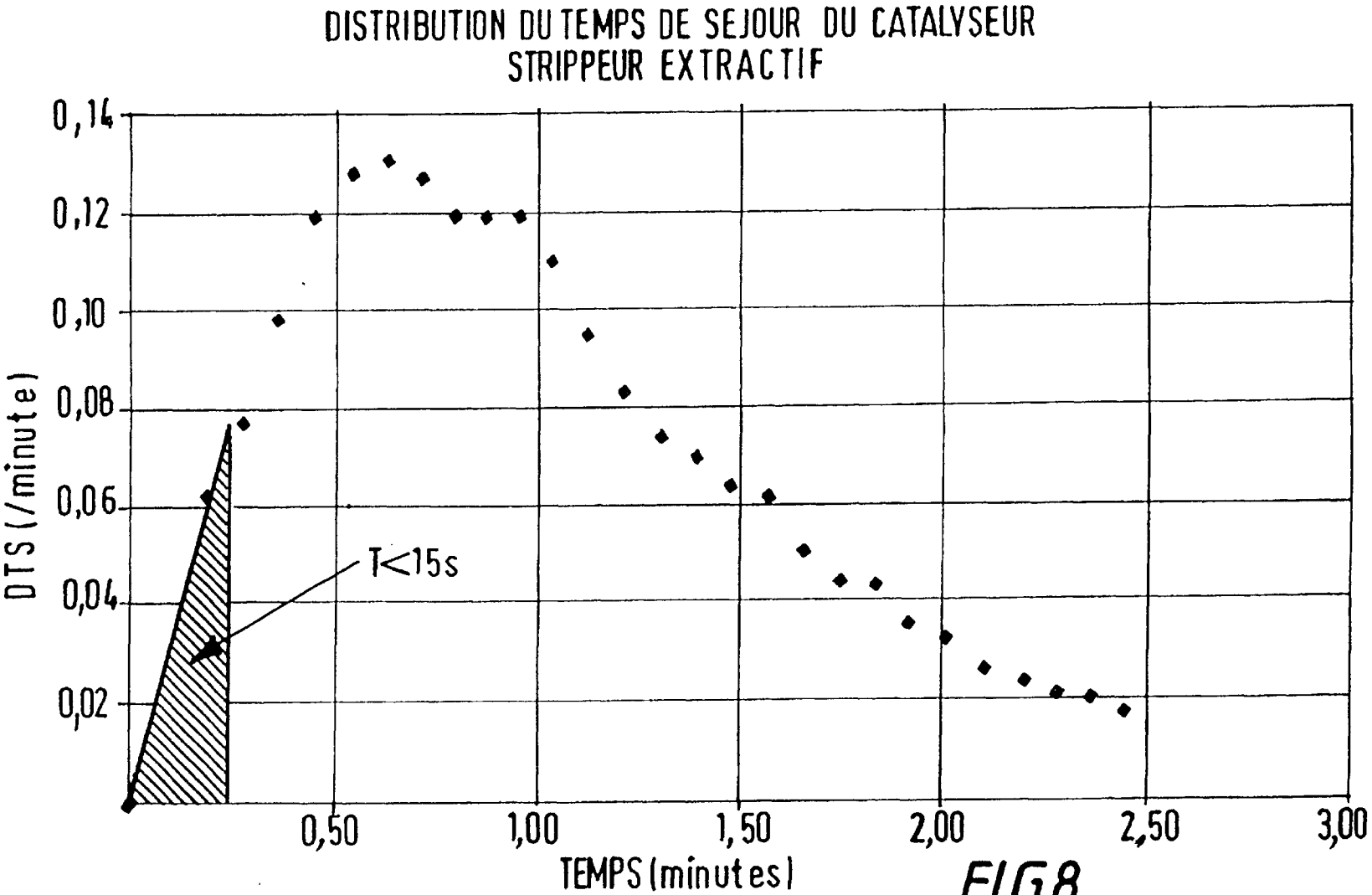
FIGS. 8 to 11 show the dwell time distribution (DTS) curves of the catalyzer as a function of time, for three types of stripper analyzed.
Figure 9:
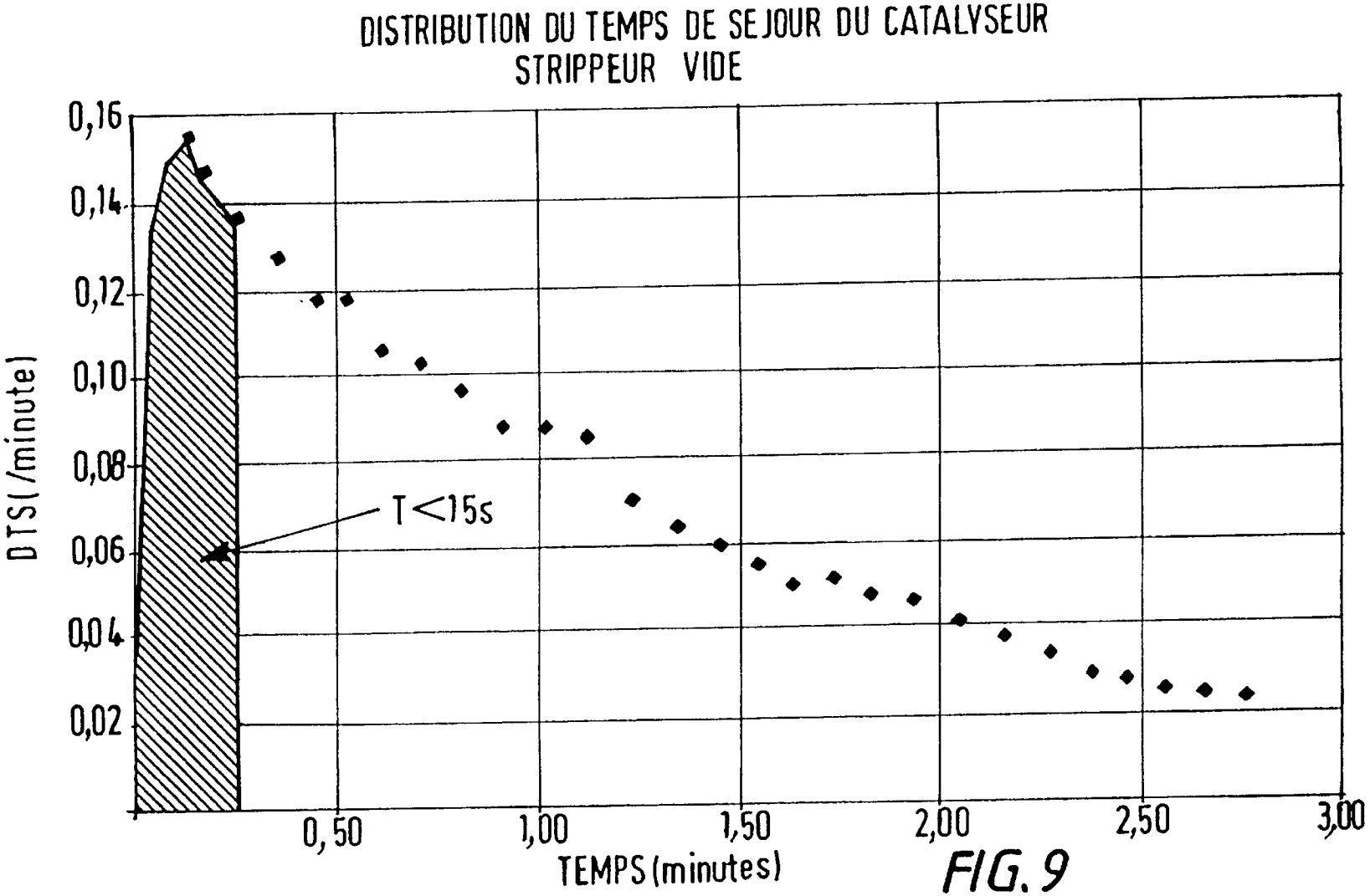
Figure 10:
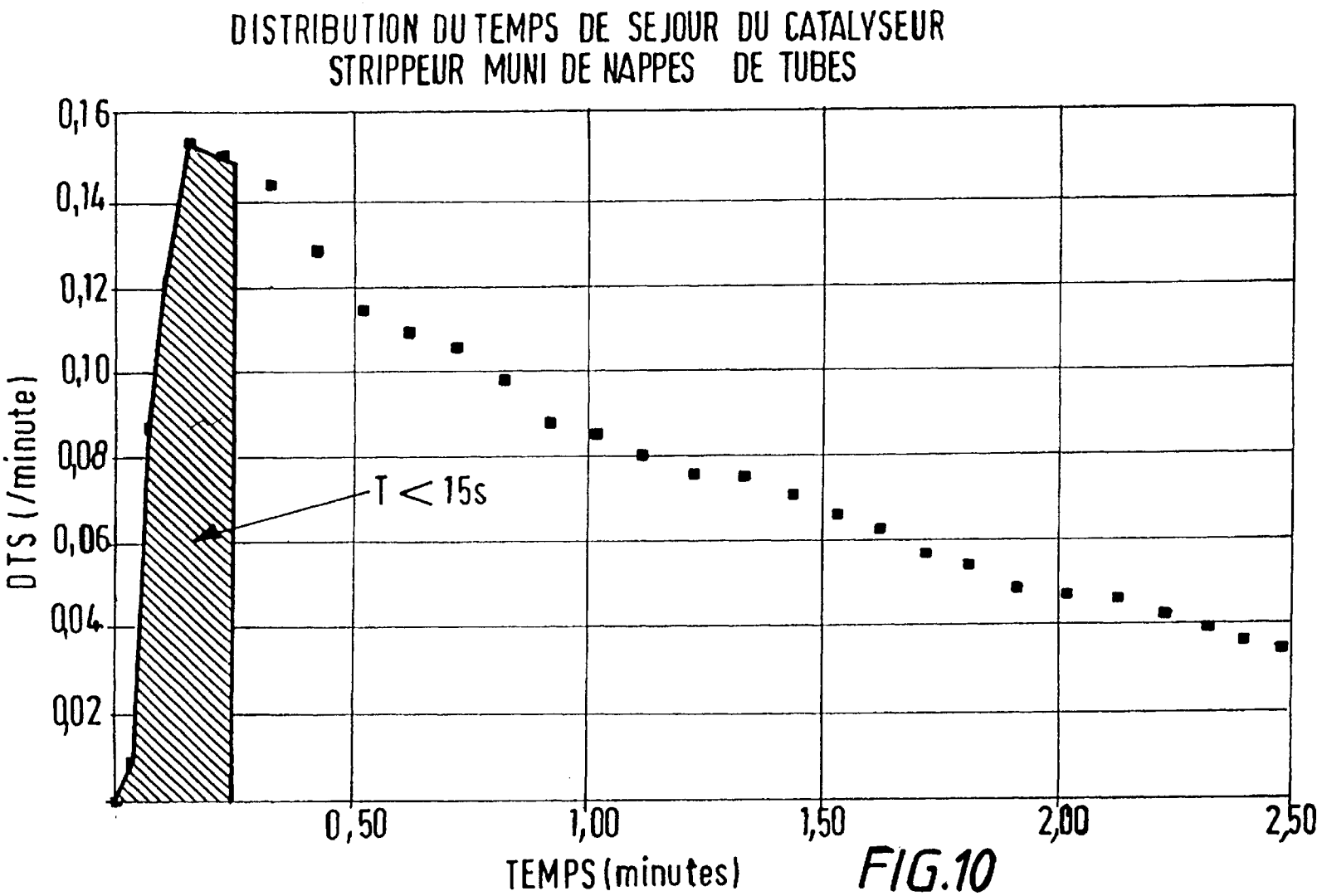

FIGS. 8 to 10 show the respective dwell time distribution curves.

Interpreting the Results

1) Evaluation of the Bypass Quantity:

As defined above, this is the quantity of catalyzer remaining less than 15 seconds in the stripper, which is poorly stripped (represented by the hatched surface of the curves of FIGS. 8 to 10), extraction stripper: 8%, empty stripper: 23%, stripper with tube sheets: 20%.

It is noted that the extraction stripper greatly reduces the "bypass", which increases the catalyzer's hydrocarbon extraction efficacy.

This is explained by the stripper's stage or chamber configuration, reducing catalyzer particle mixing.

The "bypass" that is characteristic of poor stripping efficacy and thus of excessive hydrocarbon content of the catalyzer when entering the regenerator, results in heterogeneity of the coke content of the catalyzer grains, the most loaded of which may undergo irreversible deterioration in the regenerator due to the very high local temperature generated during the combustion.

2) Effect of Retro-Mixing:

As was described in the preceding, stripped catalyzer grains rose in the wake of the bubbles to the bed surface and thus encounter desorbed hydrocarbons that they reabsorb once again. This resorption may lead to a coking-cracking reaction that forms "hard" coke (that can only be withdrawn by regeneration). This phenomenon is known as retro-mixing.

Retro-mixing is characterized on the aforementioned DTS curves by trail length, i.e., by the time the curve takes to return to the base line; the shorter this time, the greater the retro-mixing.

Figure 11:
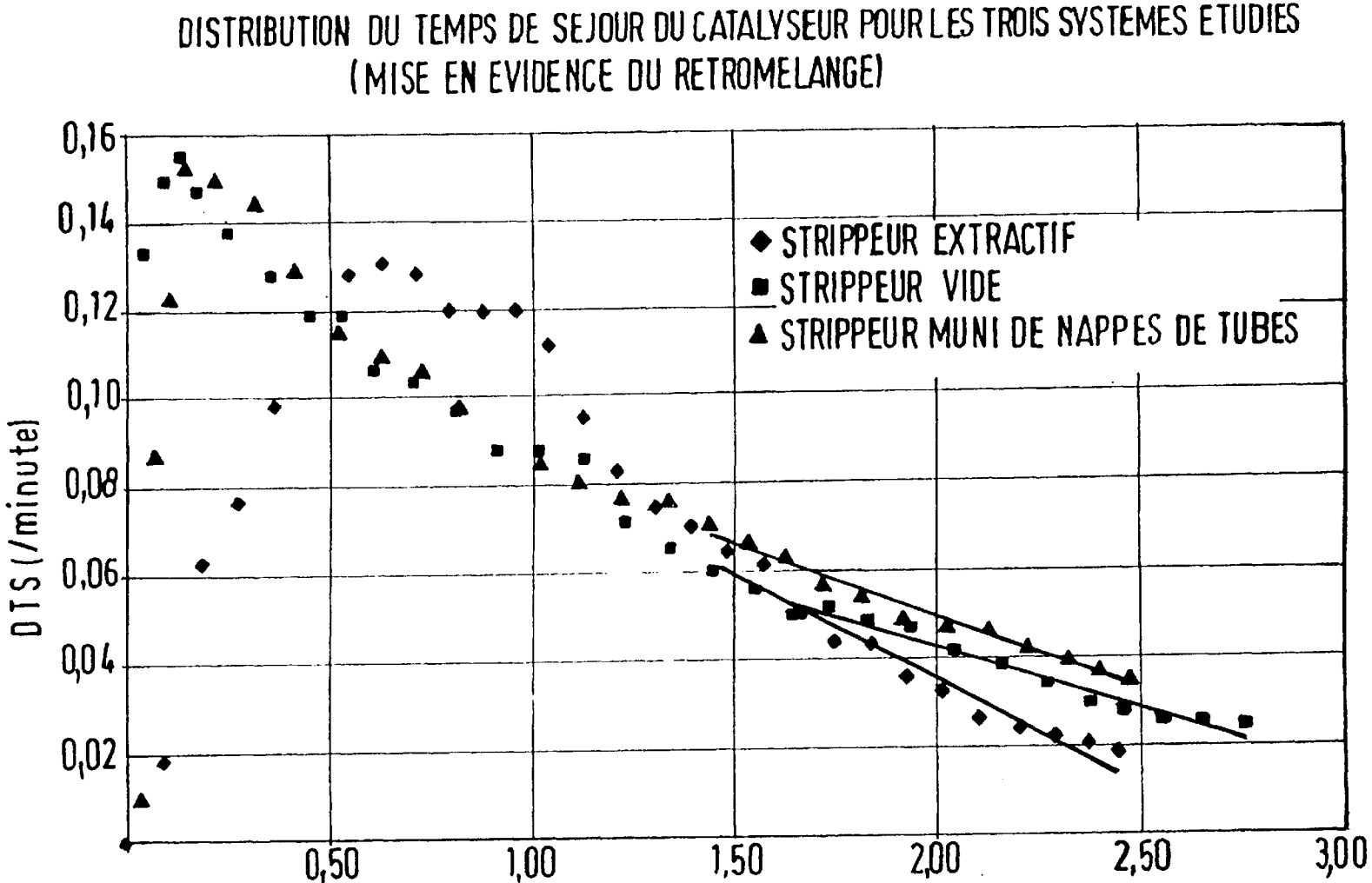

The gradients, indicative of retro-mixing magnitude, of the DTS curve trails can be compared in FIG. 11 for the 3 types of strippers: it will be noted that there is clearly less retro-mixing in the case of the extraction stripper according to the invention; there is slightly less for the stripper equipped with tube sheets than for the empty stripper.

What is claimed is:

1. Method for stripping hydrocarbon-impregnated solid particles in a fluidized bed by means of a fluid circulating against the flow direction of these particles, implemented in a housing comprising in its upper section a diluted fluidized zone where the particles to be stripped arrive, and in its lower section a dense fluidized bed zone comprising at least two chambers arranged basically adjacent, each of these chambers having separate means for inserting solid particles, and in its lower section, separate means for inserting gaseous stripping fluids, this method being characterized in that the solid particles arriving from this diluted fluidized zone are directed by a directing means toward the entrance of the first chamber without being able to directly enter the second chamber;

in that the solid particles to be stripped enter the first chamber in their entirety first of all by way of the upper section of the dense fluidized bed, in which they undergo a first stripping;

in that the solid particles having undergone this first stripping are then transferred into at least a second chamber which has in its upper section gas/solid separating means allowing the gaseous fluids from the stripping of the second chamber to pass directly from the bottom to the top, into the diluted fluidized zone located in the upper section of the housing;

and in that the solid particles having undergone a second stripping in the second chamber are then removed by way of the lower section of this second chamber.

2. Method according to claim 1, characterized in that the volume mass of the dense fluidized bed contained in each of the two chambers ranges from 400 to 800 kg/m$^3$.

3. Method according to one of claims 1 and 2, characterized in that the gaseous fluid is vapor or nitrogen.

4. Method according to claim 1, characterized in that the flow rate of the stripping fluid of the first chamber ranges from 1.5 to 4 times that of the subsequent chamber or chambers.

5. Method according to claim 1, characterized in that a substantial reduction of the stripping fluid surface speed takes place in each chamber, causing smaller bubbles to form and thus increasing the transfer of the hydrocarbons in the gaseous phase.

6. Device for stripping hydrocarbon-impregnated solid particles in a fluidized bed by means of a gaseous fluid circulating against the flow direction of these particles, comprising:

a housing provided with an upper section able to allow the forming of a diluted fluidized zone for inserting the solid particles to be stripped, and a lower section able to allow the forming of a dense fluidized stripping zone divided into at least two chambers arranged basically adjacent and each comprising a separate inserting device for solid particles and gaseous fluid, a pipe connected to the housing base for removal of the stripped particles, this device being characterized in that it comprises in the upper section of the second chamber at least one wall constituting at least one partition between these chambers working together with a deflector in order to remove the gaseous stripping fluids coming from the second chamber directly toward the diluted fluidized zone and to direct the fall of the solid particles to be stripped toward the entrance of the first stripping chamber.

7. Device according to claim 6, characterized in that this partition is formed in the lower section of the first chamber so as to have at least one opening for the particles to go from this chamber to the second chamber.

8. Device according to one of claims 6 and 7, characterized in that the partition or partitions is/are arranged basically vertical.

9. Device according to claim 6, characterized in that the partition or partitions is/are symmetric relative to the longitudinal axis XX' of the stripping housing.

10. Device according to claim 6, characterized in that the partition or partitions is/are arranged in the form of a crosswise partition.

11. Device according to claim 9, characterized in that the partitions are offset from each other relative to the longitudinal axis XX' of the stripping housing.

12. Device according to claim 6, characterized in that the deflector is arranged along the circumference of the stripping housing above the upper level of the dense fluidized bed and contiguous to the internal partition of the housing.

13. Device according to claim 6, characterized in that the deflector consists of an inclined partition starting from the internal partition of the housing toward its axis XX'.

14. Device according to claim 6, characterized in that the deflector concentrates the gaseous fluids extracted from the two chambers so as to carry out a preliminary stripping of solid particles entering the first chamber.

* * * * *